US005720548A

United States Patent [19]

Geary

[11] Patent Number: 5,720,548

[45] Date of Patent: Feb. 24, 1998

[54] HIGH LUMINANCE FLUORESCENT LAMP ASSEMBLY

[75] Inventor: Brian P. Geary, Holland, Mich.

[73] Assignee: Progressive Technology in Lighting, Inc., Holland, Mich.

[21] Appl. No.: 557,342

[22] Filed: Nov. 14, 1995

[51] Int. Cl.[6] ..... F21K 2/00

[52] U.S. Cl. ..... 362/260; 362/218; 362/226; 362/294; 362/345; 313/44

[58] Field of Search ..... 313/44, 46, 113, 313/318.01; 315/50, 56–59, 70, 71; 439/232, 236; 362/345, 218, 226, 260, 293, 294

[56] References Cited

U.S. PATENT DOCUMENTS

| | | | |
|---|---|---|---|
| 2,505,993 | 5/1950 | Rogers | 315/58 |
| 2,966,602 | 12/1960 | Waymouth et al. | 313/44 |
| 3,268,718 | 8/1966 | Ostensen | 362/218 |
| 3,309,565 | 3/1967 | Clark et al. | 362/218 |
| 3,368,071 | 2/1968 | Bentzman | 362/218 |
| 3,375,361 | 3/1968 | Thopmson et al. | 362/218 |
| 3,551,736 | 12/1970 | Doehner | 315/100 |
| 3,611,009 | 10/1971 | McNell | 315/37 |
| 3,815,080 | 6/1974 | Summa | 439/236 |
| 3,987,334 | 10/1976 | Anderson | 315/57 |
| 4,093,893 | 6/1978 | Anderson | 315/48 |
| 4,173,730 | 11/1979 | Young et al. | 315/53 |
| 4,270,071 | 5/1981 | Morton | 315/62 |
| 4,300,073 | 11/1981 | Skwirut et al. | 315/53 |
| 4,337,414 | 6/1982 | Young | 315/56 |
| 4,347,460 | 8/1982 | Latassa et al. | 315/63 |
| 4,375,607 | 3/1983 | Morton et al. | 315/56 |
| 4,405,877 | 9/1983 | Haraden et al. | 313/318.01 |
| 4,414,489 | 11/1983 | Young | 315/51 |
| 4,443,778 | 4/1984 | Mewissen | 336/90 |
| 4,449,071 | 5/1984 | Yokoyama | 315/53 |
| 4,449,072 | 5/1984 | Osada | 315/58 |
| 4,456,854 | 6/1984 | Osada | 315/58 |
| 4,570,105 | 2/1986 | Engel | 315/58 |
| 4,623,823 | 11/1986 | Engel | 315/58 |
| 4,686,412 | 8/1987 | Johnson, Jr. | 313/113 |
| 4,746,840 | 5/1988 | Lim | 315/58 |
| 4,748,380 | 5/1988 | MacDonald et al. | 315/57 |
| 4,750,096 | 6/1988 | Lim | 362/218 |
| 4,841,193 | 6/1989 | Nakamura et al. | 313/318.02 |
| 4,947,305 | 8/1990 | Gunter, Jr. | 362/218 |
| 5,030,889 | 7/1991 | El-Hamamsy et al. | 315/200 R |
| 5,128,590 | 7/1992 | Holzer | 315/58 |
| 5,174,646 | 12/1992 | Siminovitch et al. | 362/218 |
| 5,179,323 | 1/1993 | Ham | 315/239 |
| 5,390,096 | 2/1995 | DeKleine et al. | 362/346 |
| 5,506,474 | 4/1996 | Hammer et al. | 315/56 |
| 5,537,301 | 7/1996 | Martich | 362/218 |

FOREIGN PATENT DOCUMENTS

| | | |
|---|---|---|
| 2281539 | 3/1976 | France . |
| 239669 | 12/1910 | Germany . |

OTHER PUBLICATIONS

Norelco® Specification Sheet published by North American Philips Lighting Corporation, 1983.

*Primary Examiner*—Alan Cariaso

*Attorney, Agent, or Firm*—Van Dyke, Gardner, Linn & Burkhart, LLP

[57] ABSTRACT

A fluorescent-lighting adaptor assembly for a fluorescent lamp which has at least one light-emitting tube, a base, and electrical contacts on said base includes an electrical adaptor and a heat sink. The electrical adaptor includes an enclosure and electrical sockets configured to receive the lamp contacts on the enclosure. The enclosure defines at least two housing portions radially separated by at least one window and a ballast in at least one of the housing portions. The heat sink includes a wall surrounding the light-emitting tube, a heat coupling surface of the wall facing the light-emitting tube and configured to couple heat between the light-emitting tube and the wall, and a heat dissipation surface. The heat dissipation surface of the wall is positioned in the window between the enclosure portions and is configured to dissipate heat to the atmosphere.

33 Claims, 7 Drawing Sheets

HIGH LUMINANCE FLUORESCENT LAMP ASSEMBLY

BACKGROUND OF THE INVENTION

This invention relates generally to lighting devices and, more particularly, to compact fluorescent lamps utilized as floodlights or spotlight. The invention is particularly useful as a replacement for an incandescent lamp in an incandescent fixture, but may be used for other application such as permanently wired recessed lighting fixtures.

As with all lighting products, compact fluorescent lamps produce heat as well as light. In contrast to some forms of lighting, the efficiency of a fluorescent lamp is degraded with an increase in the temperature of the light-emitting tube of the lamp. Thus, if the temperature of the lamp increases beyond a particular, the light output decreases. This effect can be dramatic at significant increases in temperature. Of course, elevated temperatures also tend to reduce the service life of the lamp. Heat buildup in a compact fluoresent lamp is especially a problem with compact fluorescent lamps which enclosed, for example, by a cover member fitted over the reflector assembly. Likewise, a compact fluorescent lamp utilized as a floodlight or a spotlight mounted in a recessed fixture is more likely to be subject to an increase in lamp temperature.

The prior an is suggested the use of heat dissipating devices with compact fluorescent lamps. Such patents have not attempted to increase the light output of the lamp using such heat-dissipating devices, but have oily addressed reliability problems associated with heat build-up. Most such devices have been ineffective at preventing increased temperatures in the portion of the compact fluorescent lamp which emits light; namely the light-emitting tubes. In U.S. Pat. No. 4,750,096 for a FLUORESCENT LIGHT FIXTURE, a heat conductive housing is provided to dissipate heat from the ballast located in the interior of the housing. No provision is made for dissipating heat generated by the compact fluorescent lamp. In U.S. Pat. No. 4,746,840 entitle FLUORESCENT REFLECTOR LAMP ASSEMBLY, an attempt is made to reduce high temperatures of the fluorescent lamp by extracting heat from the base of the stem of the lamp. This is accomplished in the '840 patent by coupling the heat from the lamp base to a reflective shell made of a heat-conducting material, which dissipates the heat to the surrounding air. This patent additionally discloses that the reflector shell serves as a thermal isolation of the ballast housing by providing a heat barrier shielding between the lamp assembly and the ballast housing.

SUMMARY OF THE INVENTION

The present invention provides a means for effectively increasing lumen output of a compact fluorescent lamp. This may be accomplished by extracting heat from the light-emitting tube of the lamp, which maintains a lower lamp temperature and, therefore, high lumen output. Advantageously, lumen output may be further increased by reflecting a portion of the ultraviolet rays generated by the lamp back toward the light-emitting tubes in order to increase the excitation of the phosphor coating of the tubes and, thereby, further increase lumen output.

The present invention provides a fluorescent lighting adaptor for operating a compact fluorescent lamp having a light-emitting tube and a base. The adaptor includes an electrical adaptor assembly, having an enclosure, and a heat dissipation member having at least one surface in heat transfer coupling with a portion of the light-emitting tube of the fluorescent lamp. The member extracts heat from the light-emitting tube and dissipates the heat. In a preferred form, the heat dissipation member includes a surface that is configured to reflect a portion of the ultraviolet energy escaping the light-emitting tube back toward the light-emitting tube where the reflected UV energy may further excite the phosphor coating to increase tureen output. In this manner, the heat dissipation member is also a reflector device which performs a dual function of extracting heat from the fluorescent lamp and reducing loss of UV energy from the lamp. In this manner, the lumen output of the lamp is increased by lowering its temperature and by increasing UV energy efficiency.

According to another aspect of the invention, a fluorescent lighting adaptor includes an electrical adaptor assembly having an enclosure, an incandescent lamp connector at one end of the enclosure, electrical sockets configured to receive the lamp contacts at an intermediate portion of the enclosure, and a ballast housing at an opposite end of the enclosure. A ballast resides in the ballast housing. The fluorescent lighting adaptor additionally includes a reflector assembly having a light-reflecting surface surrounding a portion of the light-emitting tube of the lamp in order to redirect light generated by the lamp in a general direction. The fluorescent lighting adaptor further includes a heat dissipation member which surrounds a portion of the light-emitting tube and shields the ballast housing from the light-emitting tube. The heat dissipation member further includes at least one surface in heat transfer coupling with the light-emitting tube, in order to extract heat from the tube, and a heat dissipation surface for dissipating the heat to the atmosphere.

In one form, the ballast housing is divided into two or more radially spaced separate housing portions and the heat dissipation member includes dissipation surface portions which are positioned between the ballast housing portions. In this manner, a cylindrical heat dissipation member is capable of extracting heat directly from the light-emitting tube of the compact fluorescent lamp and dissipating that heat to the atmosphere while shielding the ballast housing of the adaptor.

The surface in heat transfer coupling with the multiple parallel portions of the light-emitting tube of the fluorescent lamp may include first surface portions which are curved to the contour of the tube surface and second surface portions which are positioned between the parallel portions of the light-emitting tube. This combination provides an optimal coupling of heat from the lamp light-emitting tube portions and redirection of UV energy generated by the light-emitting tube portions back toward the tube portions.

These and other objects, advantages, and features of this invention will become apparent upon review of the following specification in conjunction with the drawings.

DESCRIPTION OF THE PREFERRED EMBODIMENT

Figure 1:
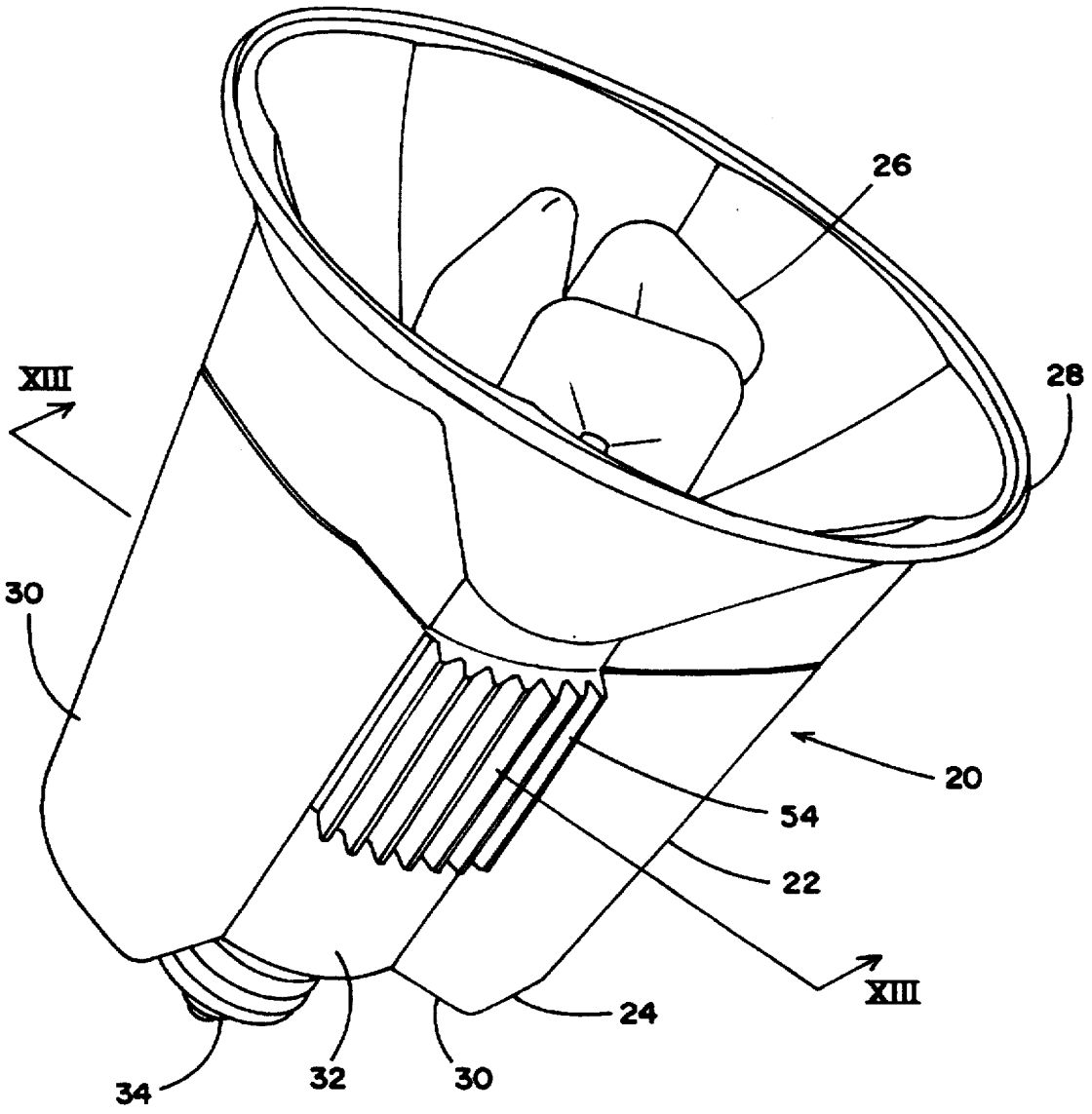
FIG. 1 is a perspective view of a fluorescent lighting adaptor assembly according to the invention.

Referring now specifically to the drawings, and the illustrative embodiments depicted therein, a fluorescent lighting adaptor assembly 20 is illustrated having an electrical adaptor 22, a compact fluorescent lamp 26 electrically and mechanically interconnected with adaptor 22, and a reflector assembly 28 surrounding portions of lamp 26 and attached to electrical adaptor 22 and a heat sink, or heat dissipation member 54 (FIGS. 1–13). Electrical adaptor 22 has a housing, or enclosure, 24 which includes a plurality of ballast housing portions 30, which extend outwardly from a central portion 32 of the housing and within which a ballast device (31) is positioned. In the illustrated embodiment, electrical adaptor 22 incorporates an electronic ballast circuit made up of electronic components, but may also be used with a magnetic ballast device. Both types of ballasts are well known in the art. In the illustrated embodiment, electrical adaptor 22 further includes an Edison base 34, which is a connector assembly capable of electrically connecting electrical adaptor 22 with an incandescent lamp socket (not shown).

Although electrical adaptor 22 is illustrated as adapting compact fluorescent lamp 26 for use with an incandescent lamp socket, the invention may be applied to electrical adaptors that are hard-wired, or otherwise, interconnected with house AC voltage. Additionally, the invention may be applied to an integral lamp and adaptor assembly in which the lamp is not removable from the adaptor.

Figure 2:
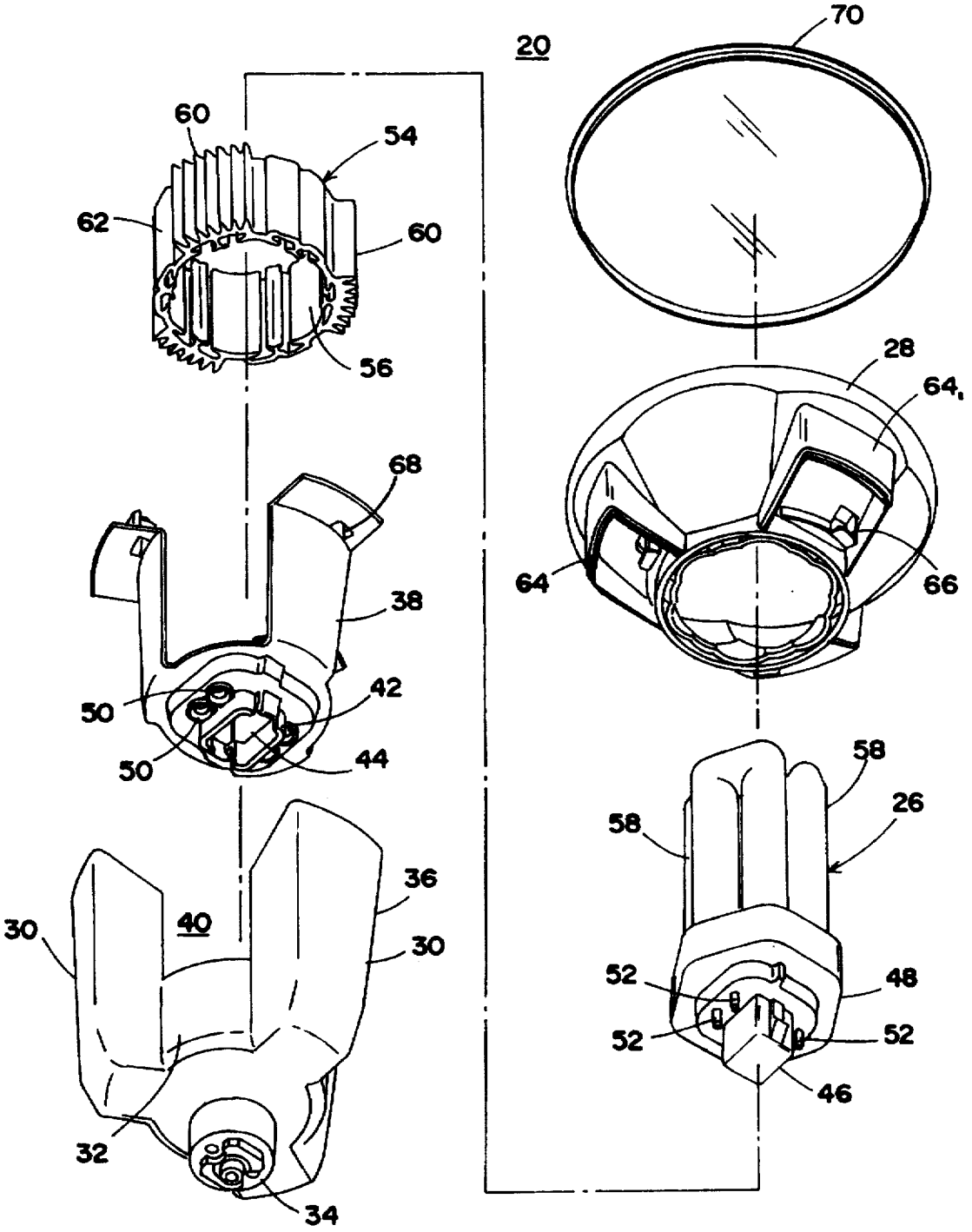
FIG. 2 is an exploded perspective view of the lighting adaptor assembly in FIG. 1.
Figure 4:
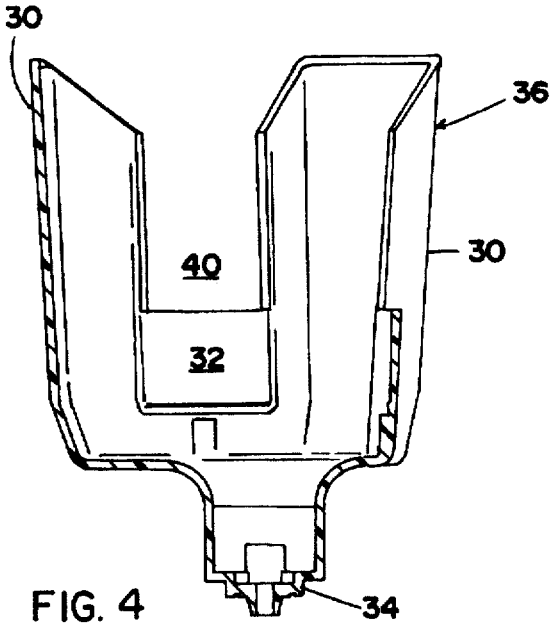
FIG. 4 is a sectional view taken along the lines IV—IV in FIG. 3.
Figure 6:
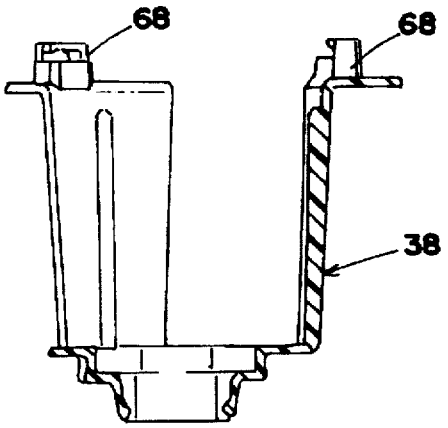
FIG. 6 is a sectional view along the lines VI—VI in FIG. 5.
Figure 3:
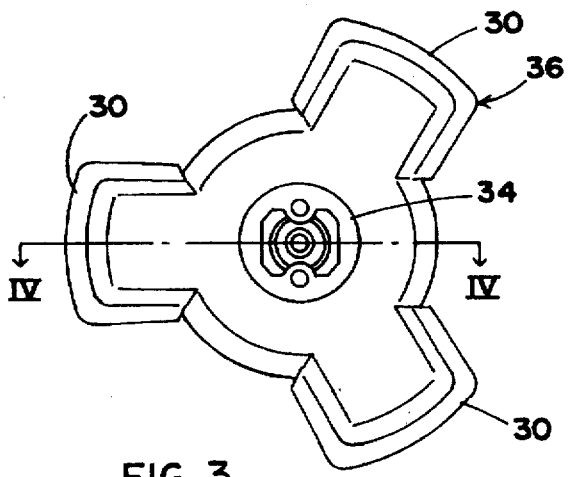
FIG. 3 is a bottom plan view of an outer housing shell for an electrical adaptor according to the invention.
Figure 5:
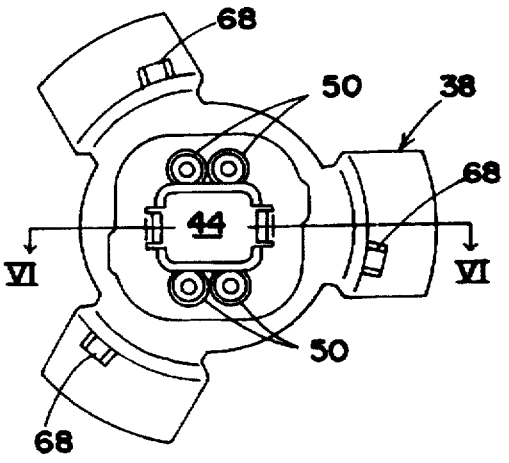
FIG. 5 is a top plan view of an inner housing which mates with the housing shell in FIG. 3.
Figure 10:
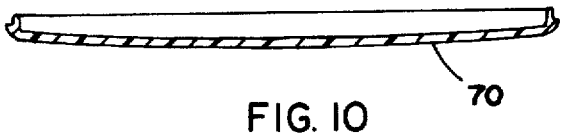
FIG. 10 is a sectional view taken along the lines X—X in FIG. 9.
Figure 9:
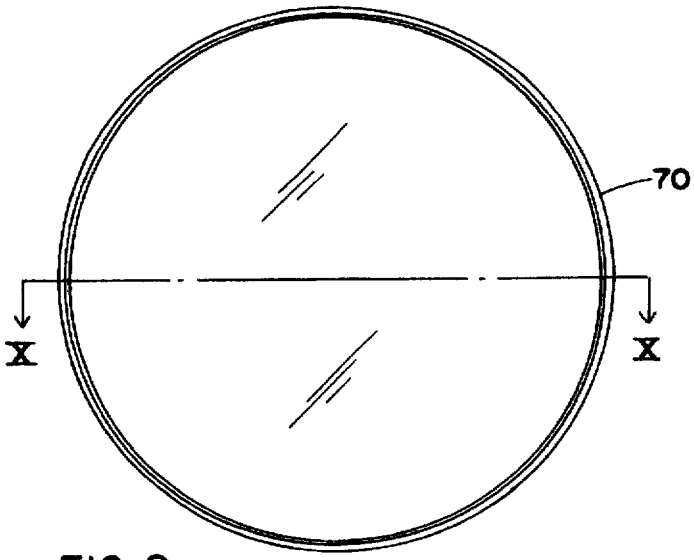
FIG. 9 is a top plan view of a reflector cover configured to be fitted with the reflector assembly in FIGS. 7 and 8.
Figure 8:
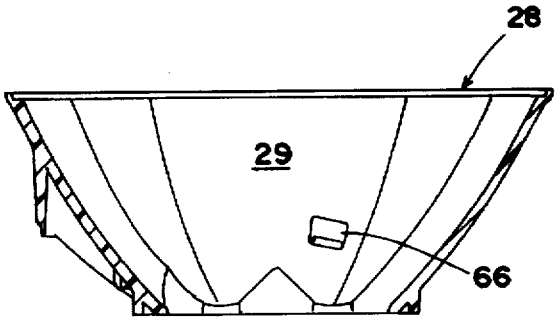
FIG. 8 is a sectional view taken along the lines VIII—VIII in FIG. 7.
Figure 7:
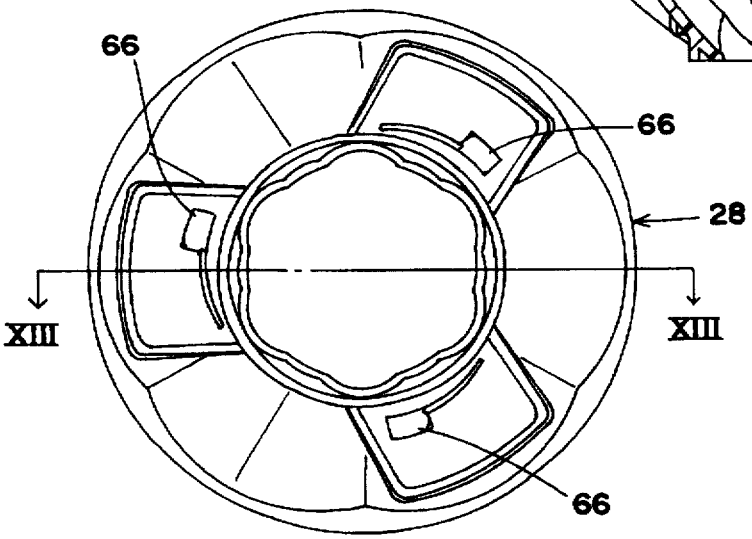
FIG. 7 is a bottom plan view of a reflector assembly useful with the invention.

As best seen by reference to FIG. 2, housing 24 is made up of an outer housing shell 36 and an inner housing shell 38 which fits with outer shell 38 in order to destine an enclosed space which includes separate radially spaced apart ballast housing portions 30 and central housing portion 32. Housing enclosure 24 includes a window 40 defined between each pair of ballast housing portions 30. Central housing portion 32 includes a wall 42 defining a central opening 44 which is configured to receive a starter housing 46 of a base 48 of compact fluorescent lamp 26. Central housing portion 32 further includes multiple electrical sockets 50 which electrical interconnect with pins 52 attached to base 48. In this manner, compact fluorescent lamp 26 may be engaged with electrical adaptor 22 by a mechanical interlock between starter housing 46 and opening 44 and by an electrical interconnection between pins 52 and sockets 50.

Heat dissipation member, or heat sink, 54 is juxtaposed with electrical adaptor 22 in the following manner. Compact fluorescent lamp 26 includes one or more parallel light-emitting tubes, or tube portions, 58 which are supported by base 48. Heat sink 54 includes an inner surface 56 which overlies and is thermally coupled with a lower portion of light-emitting tubes 58. Heat sink 54 additionally includes a plurality of heat-dissipating surfaces 60, each of which are positioned within a window 40, wherein such surfaces are exposed to atmosphere. In this manner, heat generated by light-emitting tubes 58 is thermally coupled to heat sink 54 and radiated by heat transfer surfaces 60 to the atmosphere. This heat transfer from light-emitting tubes 58 to the atmosphere lowers the temperature of the tubes and, thereby, improves the lumen output of the tubes. Heat sink 54 is made of a material having high heat conductivity, such as aluminum, copper, steel, or suitable alloy. In addition to transferring heat away from light-emitting tubes 58, heat sink 54 has a continuous wall 62 which provides a barrier between light-emitting tubes 58 and the ballast 31 contained in one or more of the ballast housing portions 30. This reduces the coupling of heat between the light-emitting tubes and the ballast circuitry.

Figure 11:
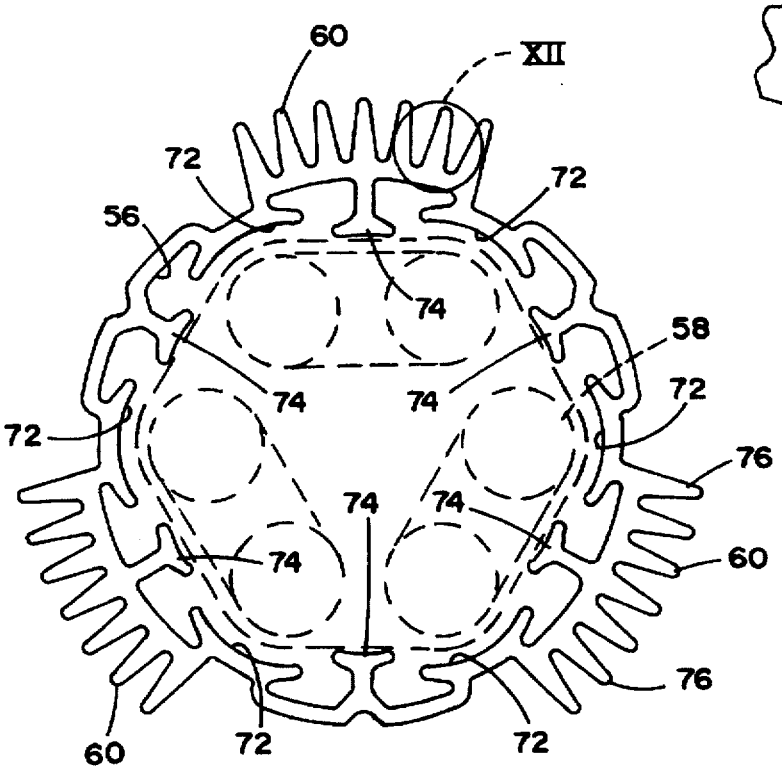
FIG. 11 is a top plan view of an embodiment of a heat dissipation member according to the invention.
Figure 13:
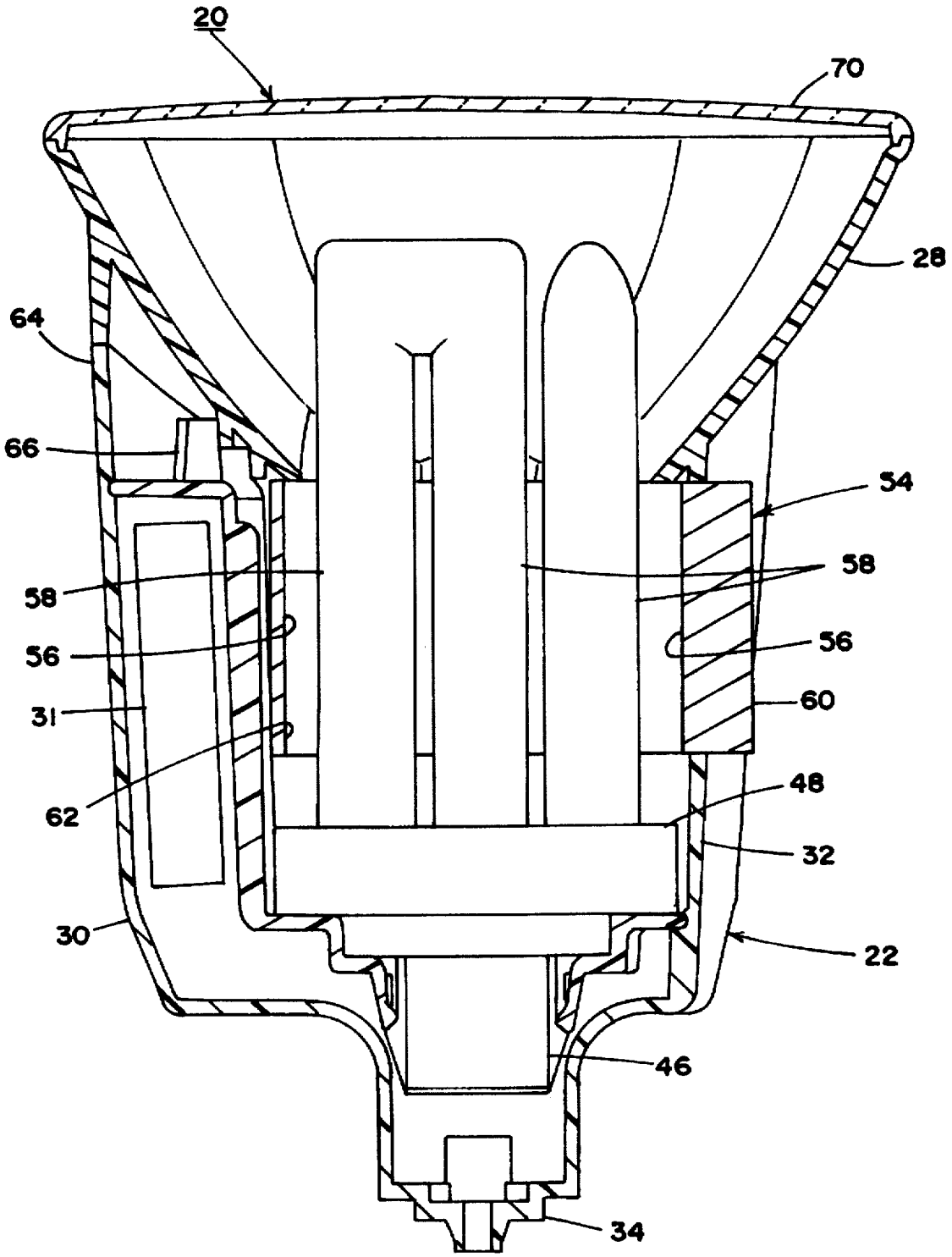
FIG. 13 is a sectional view taken along the lines XIII—XIII in FIG. 1.

Wall 62 has an inner surface 56 which is positioned close to each light-emitting tube, as first illustrated in FIG. 11. Inner surface 56 both extracts heat from tubes 58 and reflects ultraviolet (UV) energy back into tubes 58. The reflected UV energy would otherwise be radiated away from the lamp without producing useful visible light. The UV energy reflected by surface 56 causes further excitement of the phosphors lining the inner surface of tubes 58, thereby increasing the visible light output of lamp 26.

Reflector assembly 28 includes a wall **28*a* having a reflective inner surface 29 and a plurality of wall sections 64 which have the same cross-sectional configuration as the walls defining ballast housing portions 30. Wall sections 64 complete the enclosing of the ballast housing portions. A combination opening and tab 66 are positioned within each wall portion 64 and are configured to engage and lock with a mating opening and tab 68 in housing shell 38. By engaging tabs 66 and 68 and imparting a slight rotation, reflector assembly is locked to enclosure 24. Optional lens, or cover, 70 may be snap-fitted across the opening of reflector assembly 28. Lens 70 may be of a clear transparent configuration or may include stipples or the like to provide optical features in order to make the light generated by lighting adaptor assembly 20** more or less diffuse as is well known in the art.

In the embodiment illustrated in FIGS. 1–13, inner surface 56 of heat sink 54 is divided into a plurality of surface portions 72 and 74 (FIG. 11). Surface portions 72 conform to the radius of the curvature of light-emitting tubes 58. Because of such conformance, and a close spacing between surface portion 72 and tubes 58, a close heat transfer coupling is created between tubes 58 and surface portion 72 in order to extract heat from the tubes. Surface portions 74 are positioned between adjacent light-emitting tubes 58. Surface portions 74 are primarily intended to act as UV energy reflecting surfaces, and are positioned at locations of peak production of UV rays. Surface portions 74 reflect UV energy escaping tubes 58 back toward the tubes. It should be understood that surface portions 72, which are closely spaced with light-emitting tubes 58, additionally act as reflecting surfaces to reflect UV energy back toward tubes 58. In the illustrated embodiment, heat dissipation surface 60 has a ribbed configuration made up of a plurality of ribs, or fins, 76 with each rib 76 having a ribbed surface 78. Ribs 76 and fibbed surface 78 provide an enhanced amount of surface area in order to increase the efficiency of heat dissipation of heat dissipation surface 60.

Figure 14:
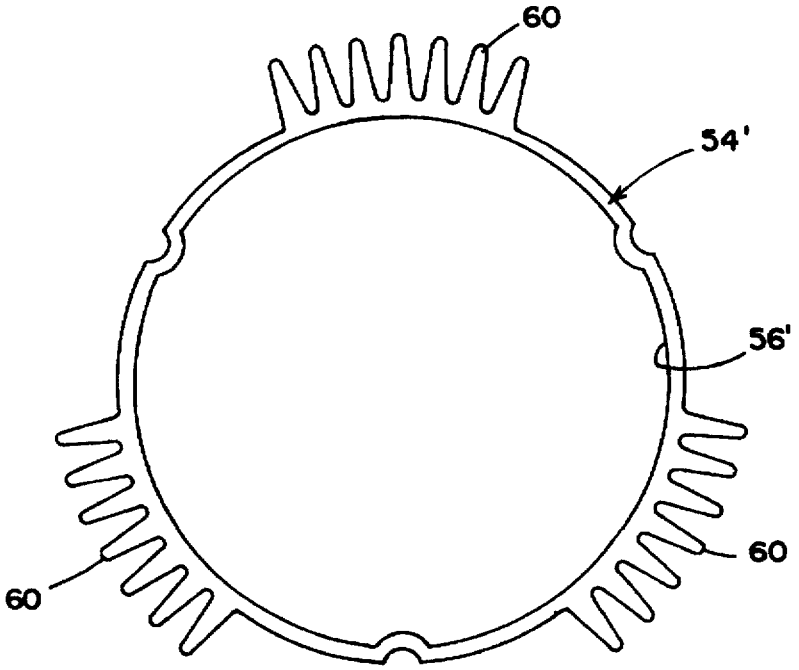
FIG. 14 is the same view as FIG. 11 of an alternative embodiment of the invention.
Figure 12:
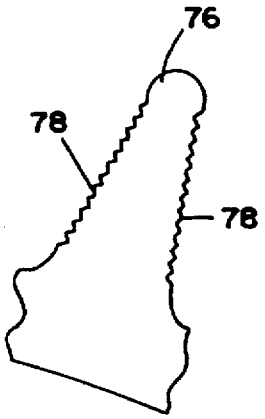
FIG. 12 is an enlarged view of the area designated XII in FIG. 11.
Figure 15:
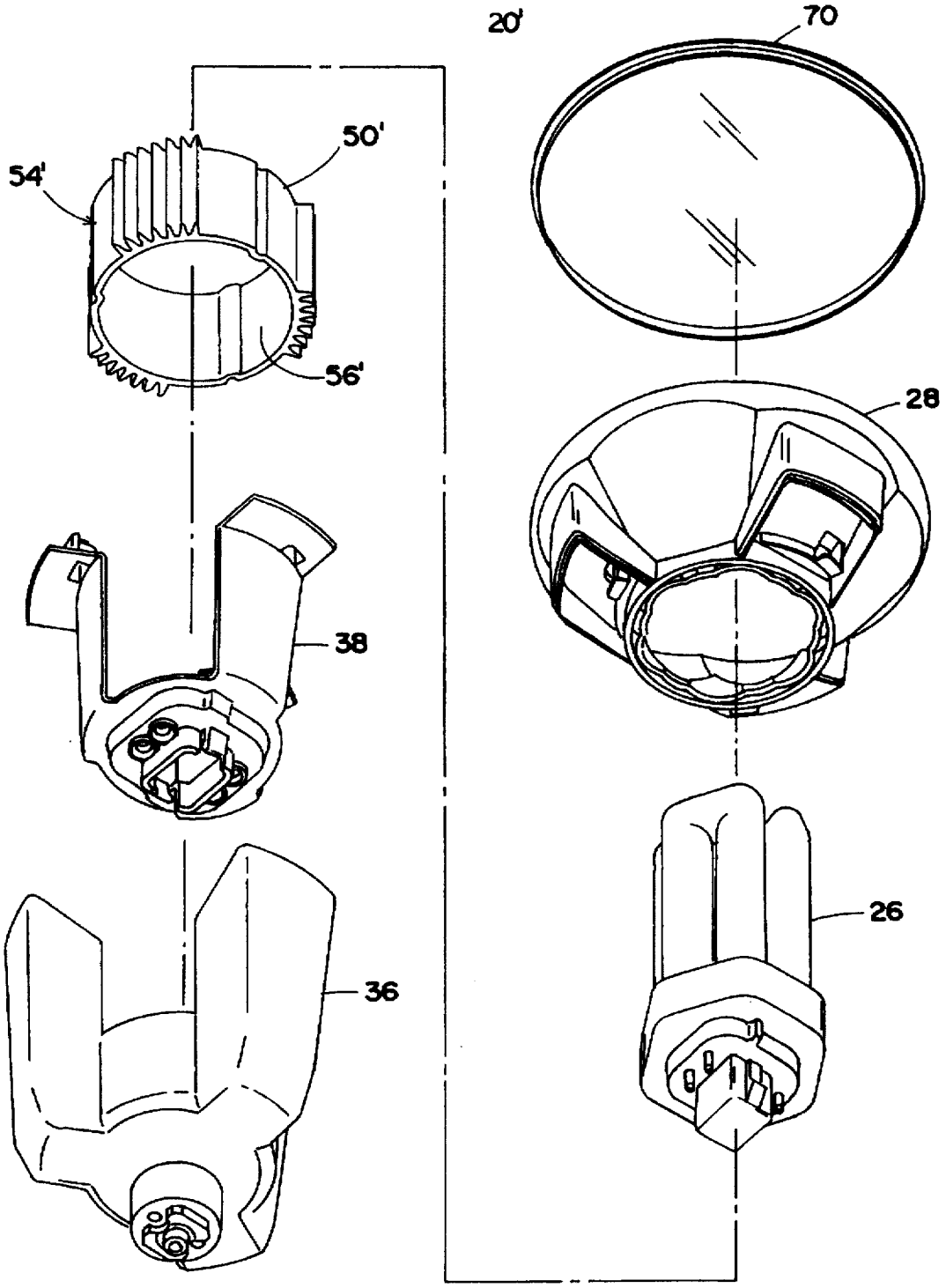
FIG. 15 is the same view as FIG. 2 of an alternative embodiment of the invention.

An alternative embodiment illustrated in FIGS. 14 and 15 of a fluorescent lighting adaptor assembly 20' includes a heat sink, or heat dissipation member, 50' which has a different configuration of inner surface 56'. Inner surface 56' surrounds and is in heat transfer coupling with a lower portion of light-emitting tubes 58 adjacent base 48. The configuration of inner surface 56' is smooth and relatively regular. The spacing between inner surface 56' and light-emitting tubes 58 is similar to that of the spacing between surface portions 72 and light-emitting tubes 58 for fluorescent lighting adaptor assembly 20. In this manner, inner surface 56' provides heat transfer coupling with light-emitting tubes 58 and reflects UV energy radiated from light-emitting tubes 58 back toward the tubes.

Although the invention is illustrated with three heat transfer surfaces 60 interspersed between three ballast housing portions 30, the member of heat transfer surfaces and ballast housing portions may be greater than or less than this number. Furthermore, although the invention is illustrated with a compact fluorescent tube having three hairpin light-emitting tube sets, the invention may be adapted to compact fluorescent lamps having a greater or lesser number of light-emitting tube sets. Additionally, heat sink 50, 50' may be configured such that base 48 of the compact fluorescent lamp may pass through inner surface 56 in order to replace the lamp. This allows the lamp to be replaced without the necessity of removing heat sink 54. Alternatively, the spacing between inner surface 56 and light-emitting tube 58 may be reduced and thereby increases the efficiency of the heat transfer coupling by requiring that the heat sink 54 be removed in order to replace the lamp. Furthermore, the heat sink may be applied to an integral compact fluorescent lamp assembly in which the light-emitting tubes are permanently joined with the assembly enclosure.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A fluorescent lighting assembly, comprising:

a light-emitting tube;

an enclosure joined with said light-emitting tube and an Edison base on said enclosure configured to engage an incandescent lamp socket and electrical sockets on said enclosure configured to receive electrical contacts of a compact fluorescent lamp; and a heat dissipation member including a wall at least partially surrounding said light-emitting tube defining at least one surface closely spaced from said light-emitting tube thereby providing heat transfer coupling with a portion of said light-emitting tube for extracting heat from said light-emitting tube and dissipating said heat away from the light-emitting tube while accommodating relative movement between said light-emitting tube and said heat dissipation member.

2. The lighting assembly in claim 1 including a reflector assembly having a surface generally surrounding another portion of said light-emitting tube, said surface configured to redirect light generated by said another portion of said light-emitting tube in a general direction away from the light-emitting tube.

3. A fluorescent lighting assembly, comprising:

a light-emitting tube;

an enclosure joined with said light-emitting tube;

a heat dissipation member including at least one surface in heat transfer coupling with a portion of said light-emitting tube for extracting heat from said light-emitting tube and dissipating said heat away from the light-emitting tube; and a reflector assembly having a surface generally surrounding another portion of said light-emitting tube, said surface configured to redirect light generated by said another portion of said light-emitting tube in a general direction away from the light-emitting tube;

wherein said light emitting-tube includes a source of ultraviolet energy and a phosphor coating excited by said source for emitting light and wherein said heat dissipation member includes a surface that is configured to redirect ultraviolet energy radiated by said portion of the light-emitting tube back into said light-emitting tube, further exciting said phosphor coating.

4. A fluorescent lighting assembly, comprising:

a light-emitting tube;

an enclosure joined with said light-emitting tube; and a heat dissipation member including at least one surface in heat transfer coupling with a portion of said light-emitting tube for extracting heat from said light-emitting tube and dissipating said heat away from the light-emitting tube;

wherein said light-emitting tube includes a source of ultraviolet energy and a phosphor coating excited by said source for emitting light and wherein said heat dissipation member includes a surface that is configured to redirect ultraviolet energy radiated by said portion of the light-emitting tube back into said light-emitting tube, further exciting said phosphor coating.

5. The lighting assembly in claim 1 wherein said heat dissipation member includes a heat dissipation surface for dissipation of said heat to surrounding atmosphere.

6. The lighting assembly in claim 5 wherein said heat dissipation surface includes a plurality of fins.

7. The lighting assembly in claim 6 wherein said fins are made up of grooved surfaces.

8. A fluorescent lighting assembly, comprising:

a light-emitting tube;

an enclosure joined with said light-emitting tube; and a heat dissipation member including a wall at least partially surrounding said light-emitting tube defining at least one surface in heat transfer coupling with a portion of said light-emitting tube for extracting heat from said light-emitting tube and dissipating said heat away from the light-emitting tube;

wherein said enclosure includes a ballast housing and a ballast in said housing and wherein said wall substantially separates said light-emitting tube from said ballast housing, thereby substantially thermally isolating said ballast housing from heat generated by said light-emitting tube.

9. A fluorescent lighting assembly, comprising:

a light-emitting tube;

an enclosure joined with said light-emitting tube;

a heat dissipation member including at least one surface in heat transfer coupling with a portion of said light-emitting tube for extracting heat from said light-emitting tube and dissipating said heat away from the light-emitting tube wherein said heat dissipation member includes a heat dissipation surface for dissipation of said heat to surrounding atmosphere; and wherein said enclosure includes a ballast housing and a ballast in said housing and wherein said heat dissipation member thermally isolates said ballast housing from heat generated by said light generation device;

wherein said ballast housing is divided into multiple radially spaced apart housing portions and wherein said heat dissipation member includes a heat dissipation surface positioned between said housing portions.

10. The lighting assembly in claim 9 wherein said heat dissipation surface includes a plurality of fins.

11. The lighting assembly in claim 10 wherein said fins are made up of grooved surfaces.

12. A fluorescent lighting adaptor assembly for a fluorescent lamp, said fluorescent lamp having a light-emitting tube, a base, and electrical contacts on said base, said light-emitting tube including a source of ultraviolet energy and a phosphor coating excited by said source for emitting light, comprising:

an electrical adaptor assembly including an enclosure, an Edison base at one end of said enclosure, electrical sockets configured to receive said lamp contacts at an intermediate portion of said enclosure, a ballast housing at an opposite end of said enclosure, and a ballast in said housing;

a reflector assembly having a light-reflecting surface substantially surrounding a first portion of a light-emitting tube of a lamp engaged with said lighting adaptor for redirecting light generated by said portion in a general direction; and a heat dissipation member including at least one surface in heat transfer coupling with a second portion of the light-emitting tube of a fluorescent lamp engaged with said adaptor assembly for extracting heat from said light-emitting tube and dissipating said heat away from said lamp, wherein said at least one surface further redirects ultraviolet energy radiated by said second portion of the light-emitting tube back into the light-emitting tube further exciting the phosphor coating of the light-emitting tube.

13. The lighting adaptor assembly in claim 12 wherein said heat dissipation member is positioned between said ballast housing and the light-emitting tube of a fluorescent lamp in said adaptor assembly in order to thermally isolate said ballast from said light-emitting tube.

14. The lighting adaptor assembly in claim 12 wherein said heat dissipation member includes a heat dissipation surface for dissipating said heat to the surrounding atmosphere.

15. The lighting adaptor assembly in claim 14 wherein said heat dissipation surface includes a plurality of fins.

16. The lighting adaptor assembly in claim 15 wherein said fins are made up of grooved surfaces.

17. A fluorescent lighting adaptor assembly for a fluorescent lamp, said fluorescent lamp having a light-emitting tube, a base, and electrical contracts on said base comprising:

an electrical adaptor including an enclosure and electrical sockets configured to receive said lamp contacts on said enclosure, said enclosure defining at least two housing portions radially separated by at least one window, and a ballast in at least one of said housing portions; and a heat sink configured to be positioned at least in part between said enclosure portions and the light-emitting tube of a lamp connected with said sockets, said heat sink including a wall surrounding said light-emitting tube, a heat coupling surface of said wall facing said light-emitting tube and configured to couple heat between said light-emitting tube and said wall, a heat dissipation surface of said wall facing away from said light-emitting tube and configured to dissipate heat to the atmosphere.

18. The lighting adaptor assembly in claim 17 wherein said heat dissipation surface is positioned in said window.

19. The lighting adaptor assembly in claim 17 wherein said heat coupling surface reflects ultraviolet light radiated by said tube back toward the position of the tube to further excite phosphors coating the tube.

20. The lighting adaptor assembly in claim 17 wherein said heat dissipation surface includes a plurality of fins.

21. The lighting adaptor assembly in claim 20 wherein said fins are made up of grooved surfaces.

22. The lighting adaptor assembly in claim 17 including at least three of said housing portions and at least three of said heat dissipation surfaces positioned in windows defined between said housing portions.

23. A fluorescent lighting adaptor assembly for a fluorescent lamp, said fluorescent lamp having a light-emitting tube, a base, and electrical contacts on said base, said light-emitting tube including a source of ultraviolet energy and a phosphor coating excited by said source for emitting light, comprising:

an enclosure adaptor including an enclosure, electrical sockets configured to receive the electrical contacts of a fluorescent lamp and an Edison base configured to engage an incandescent lamp socket; and a heat dissipation member including a wall at least partially surrounding said light-emitting tube defining at least one surface closely spaced from said light-emitting tube thereby providing heat transfer coupling with a portion of said light-emitting tube of a fluorescent lamp engaged with said adaptor assembly for extracting heat from said light-emitting tube and dissipating said heat away from the lamp while accommodating relative movement between said light-emitting tube and said heat dissipation member.

24. The lighting adaptor assembly in claim 23 including a reflector assembly having a surface generally surrounding another portion of said light-emitting tube, said surface configured to redirect light generated by said another portion of said light-emitting tube in a general direction away from the light-emitting tube.

25. A fluorescent lighting adaptor assembly for a fluorescent lamp, said fluorescent lamp having a light-emitting tube, a base, and electrical contacts on said base, said light-emitting tube including a source of ultraviolet energy and a phosphor coating excited by said source for emitting light, comprising:

an enclosure adaptor including an enclosure and electrical sockets configured to receive the electrical contacts of a fluorescent lamp;

a heat dissipation member including at least one surface in heat transfer coupling with a portion of said light-emitting tube of a fluorescent lamp engaged with said adaptor assembly for extracting heat from said light-emitting tube and dissipating said heat away from the lamp; and a reflector assembly having a surface generally surrounding another portion of said light-emitting tube, said surface configured to redirect light generated by said another portion of said light-emitting tube in a general direction away from the light-emitting tube;

wherein said heat dissipation member includes a surface that is configured to redirect ultraviolet energy radiated by said portion of the light-emitting tube back into said light-emitting tube, further exciting said phosphor coating.

26. A fluorescent lighting adaptor assembly for a fluorescent lamp, said fluorescent lamp having a light-emitting tube, a base, and electrical contacts on said base, said light-emitting tube including a source of ultraviolet energy and a phosphor coating excited by said source for emitting light, comprising:

enclosure adaptor including an enclosure and electrical sockets configured to receive the electrical contacts of a fluorescent lamp; and a heat dissipation member including at least one surface in heat transfer coupling with a portion of said light-emitting tube of a fluorescent lamp engaged with said adaptor assembly for extracting heat from said light-emitting tube and dissipating said heat away from the lamp;

wherein said heat dissipation member includes a surface that is configured to redirect ultraviolet energy radiated by said portion of the light-emitting tube back into said light-emitting tube, further exciting said phosphor coating.

27. The lighting adaptor assembly in claim 23 wherein said heat dissipation member includes a heat dissipation surface for dissipation of said heat to surrounding atmosphere.

28. The lighting adaptor assembly in claim 27 wherein said heat dissipation surface includes a plurality of fins.

29. The lighting adaptor assembly in claim 28 wherein said fins are made up of grooved surfaces.

30. A fluorescent lighting adaptor assembly for a fluorescent lamp, said fluorescent lamp having a light-emitting tube, a base, and electrical contacts on said base, said light-emitting tube including a source of ultraviolet energy and a phosphor coating excited by said source for emitting light, comprising:

an enclosure adaptor including an enclosure and electrical sockets configured to receive the electrical contacts of a fluorescent lamp; and a heat dissipation member including a wall at least partially surrounding said light-emitting tube defining at least one surface in heat transfer coupling with a portion of said light-emitting tube of a fluorescent lamp engaged with said adaptor assembly for extracting heat from said light-emitting tube and dissipating said heat away from the lamp;

wherein said enclosure includes a ballast housing and a ballast in said housing and wherein said wall substantially separates said light-emitting tube from said ballast housing, thereby substantially thermally isolating said ballast housing from heat generated by said light-emitting diode.

31. The lighting adaptor assembly in claim 30 wherein said ballast housing is divided into multiple radially spaced apart housing portions and wherein said heat dissipation member includes a heat dissipation surface positioned between said housing portions.

32. The lighting adaptor assembly in claim 31 wherein said heat dissipation surface includes a plurality of fins.

33. The lighting adaptor assembly in claim 32 wherein said fins are made up of grooved surfaces.

* * * * *